United States Patent [19]

Meadows et al.

[11] Patent Number: 4,474,566

[45] Date of Patent: Oct. 2, 1984

[54] METHOD AND APPARATUS FOR FOLDING A WEB HAVING A TRANSVERSE SLIT

[75] Inventors: Clayton D. Meadows, Itasca, Ill.; Gerald L. Wallace, Pewaukee, Wis.

[73] Assignee: The Wessel Company, Inc., Elk Grove Village, Ill.

[21] Appl. No.: 392,019

[22] Filed: Jun. 25, 1982 (Under 37 CFR 1.47)

[51] Int. Cl.[3] ..... B41L 43/04

[52] U.S. Cl. ..... 493/346; 493/233; 493/439; 226/88; 226/168

[58] Field of Search ..... 226/88; 270/37, 39, 270/40, 41; 493/210, 216, 223, 231, 233, 248, 256, 257, 346, 438, 439

[56] References Cited

U.S. PATENT DOCUMENTS 4,066,251 1/1978 Johnsen ..... 270/37
4,304,561 12/1981 Shingo ..... 493/439
4,337,058 6/1982 Lerner ..... 493/210 X
4,420,148 12/1983 Meadows ..... 493/439 X

*Primary Examiner*—Robert L. Spruill
*Assistant Examiner*—Steven P. Weihrouch
*Attorney, Agent, or Firm*—Marshall, O'Toole, Gerstein, Murray & Bicknell

[57] ABSTRACT

A continuous web of paper has a longitudinally extending marginal part folded over onto an adjacent longitudinally extending second part of the web. The web is in tension, and the second web part has a transverse slit. During the folding step, the marginal part is folded out of the plane of the web thereby increasing the tension on the second web part. A ribbon of flexible material is disposed beneath, and conformed to the contours of, the second web part during the folding step, to absorb some of the tension on the second part so as to prevent transverse tearing from the transverse slit across the second part of the web.

14 Claims, 6 Drawing Figures

METHOD AND APPARATUS FOR FOLDING A WEB HAVING A TRANSVERSE SLIT

BACKGROUND OF THE INVENTION

The present invention relates generally to methods and apparatuses for folding paper and more particularly to a method and apparatus for folding a continuous web of paper having a transverse slit.

Method and apparatuses of the type to which the present invention relates are used in the mass production of large volumes of printed booklets. In such methods, high speed equipment is used to print copy repetitively on a continuous web of paper advancing in a longitudinal direction along a predetermined path. The continuous web of paper has a longitudinally extending marginal part and a longitudinally extending second part located alongside the marginal part. After copy has been printed on the web, the web is subjected to a folding operation in which the marginal part of the web is folded out of the plane of the web and then into lapping relation with the second part of the web. Lines and strips of adhesive may be applied to the web at preselected locations thereon, before folding, so that, as a result of the folding operation, the marginal web part is adhered to the second web part adjacent a longitudinal edge of the former, and along a series of longitudinally spaced lateral lines of adhesion to form a series of pockets extending in end to end relation longitudinally along the web.

For reasons sometimes connected with manufacturing operations occurring at a location downstream of the location or station where the folding is performed, the web is often-times subjected to tension at the folding station. During the folding operation, when the marginal part of the web is folded out of the plane of the web, some or all of the tension which had been exerted on the marginal part of the web is exerted on the second part of the web.

When the method and apparatus described above are used to manufacture a booklet-type ticket-holder, such as for holding an airline ticket, a transverse slit is cut in the second part of the web, and the cutting occurs at a location upstream of the folding station. The transverse slit is used for inserting a ticket through the slit into the pocket formed when the marginal web part is adhered to the second web part as a result of the folding operation.

As noted above, when a tensioned web is subjected to a folding operation of the type described above, there is an increase in the tension exerted against the second web part, and when the second web part has a transverse slit therein, there is a possibility of transverse tearing from the slit, across the second part of the web, during the folding operation. This, of course, is undesirable.

SUMMARY OF THE INVENTION

Transverse tearing from the slit, across the second part of the web, during the folding step, is prevented by utilizing a method and apparatus in accordance with the present invention. The invention utilizes a longitudinally extending ribbon of flexible material having upstream and downstream ends. This ribbon is located below the path of travel of the web in close proximity to the web in the vicinity of the folding station. The second part of the web (i.e., the part with the transverse slit therein) is run over the ribbon of flexible material during the folding step, and the ribbon is conformed to the contour of the second web part during at least that part of the folding step in which the marginal part of the web has been folded out of the plane of the web. The conformed ribbon absorbs some of the tension exerted on the second part of the web during the folding step. The drag exerted by the conformed ribbon against the second web part is below that drag which would break the tensioned web.

Other features and advantages are inherent in the method and apparatus claimed and disclosed or will become apparent to those skilled in the art from the following detailed description in conjunction with the accompanying diagrammatic drawings.

DETAILED DESCRIPTION

Figure 2:
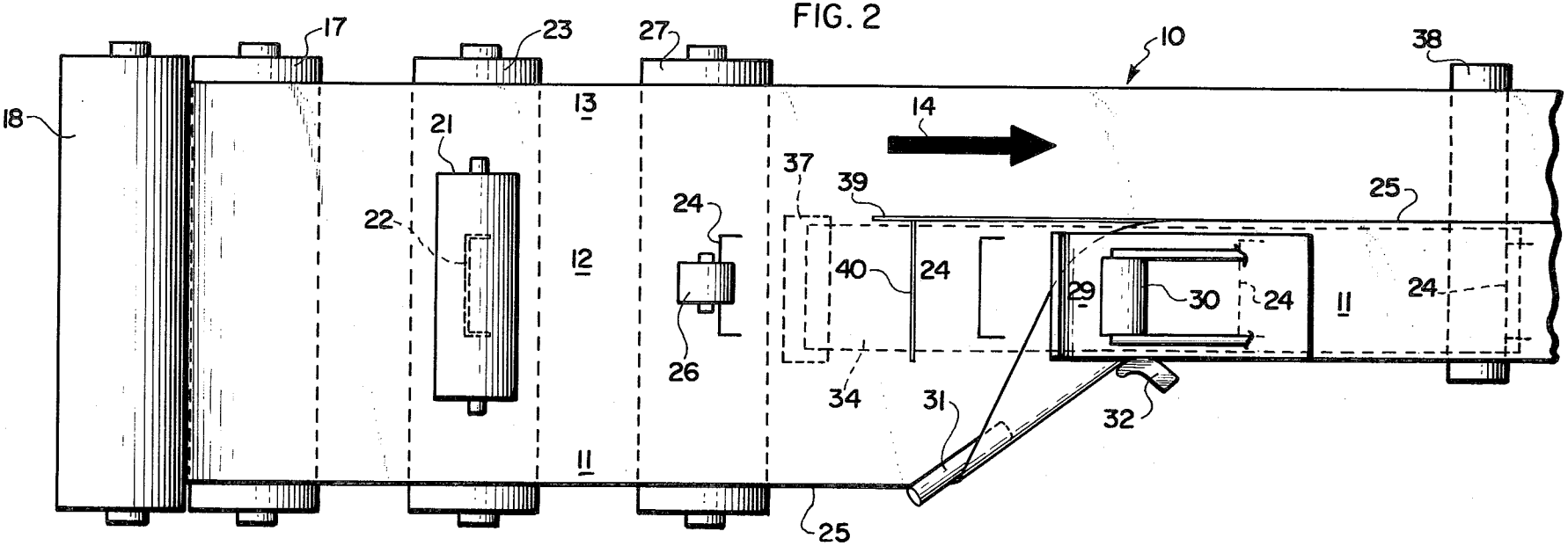
FIG. 2 is a plan view of the upstream portion illustrated in FIG. 1.

Referring initially to FIG. 2 there is illustrated a continuous web of paper 10 having one longitudinally extending marginal part 11, a longitudinally extending second part 2 located alongside marginal part 11, and another longitudinally extending marginal part 13 located alongside second web part 12, opposite the one marginal part 11.

Referring now to FIGS. 1–4, web 10 is advanced downstream in a longitudinal direction along a predetermined path in a sequence illustrated sequentially in FIGS. 1–4. The direction of advancement is indicated by the arrows 14.

Figure 1:
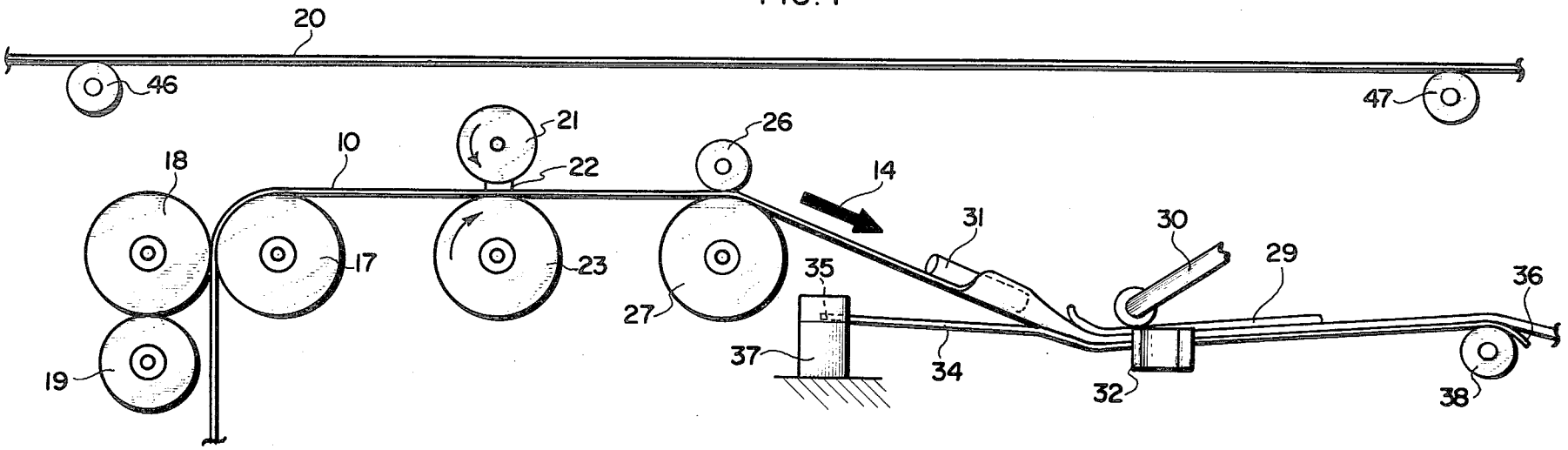
FIG. 1 is a side view illustrating an upstream portion of an embodiment of a method and apparatus in accordance with the present invention.
Figure 3:
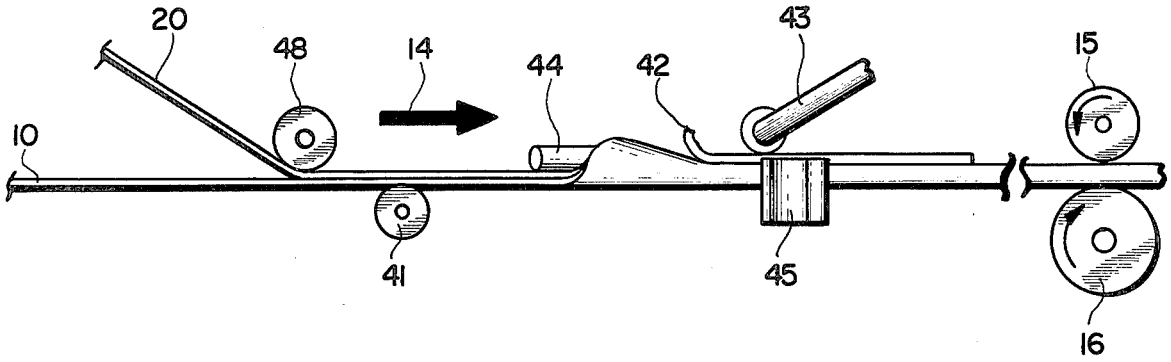
FIG. 3 is a side view of a downstream portion of the method and apparatus.
Figure 4:
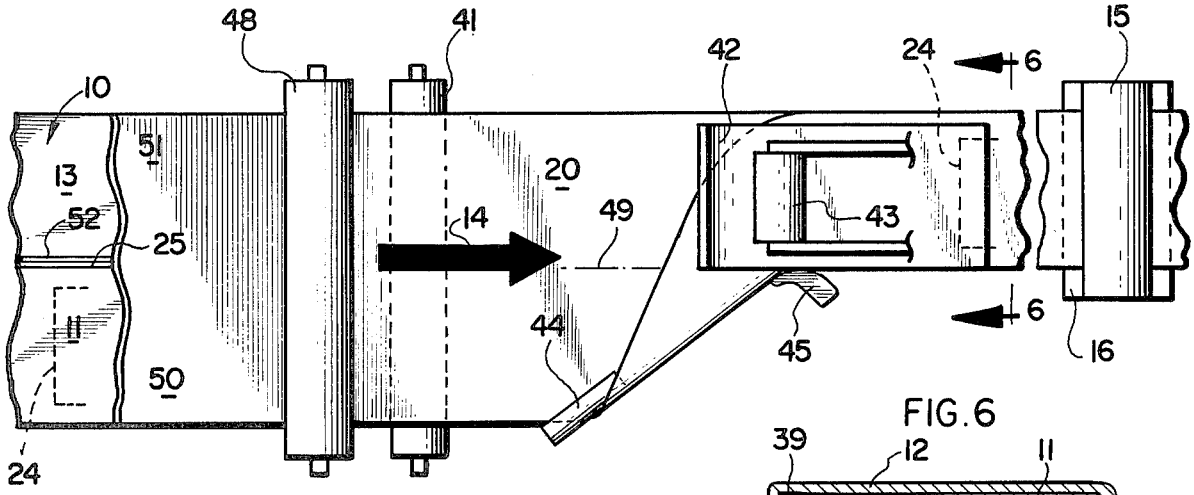
FIG. 4 is a plan view of the downstream portion illustrated in FIG. 3.

Located above continuous web 10 is a second continuous web of paper 20, which is also advanced downstream in a longitudinal direction along a predetermined path illustrated in FIGS. 1 and 3–4.

In accordance with the present invention, a printing step is performed on each of the two webs 10, 20, at a printing station (not shown) located upstream of the path portion illustrated in FIGS. 1 and 2. Copy is printed repetitively on both webs 10 and 20. Preferably, both webs 10 and 20 were originally part of a single web and, after the printing step, the original web was slit to form two separate webs 10, 20, which were then directed to the different respective vertical levels illustrated in FIG. 1.

In that part of the path portion illustrated in FIGS. 1 and 2, a transverse slit 24 is cut in second part 12 of web 10, following which marginal part 11 is folded out of the plane of web 10 and then into lapping relation with second web part 12. This occurs at a first folding station illustrated in FIGS. 1–2. After that folding step, web 10 is advanced downstream to the path portion illustrated in FIGS. 3–4. In this downstream portion of the path, second web 20 is laid atop first web 10, and the two webs, in lapping relation, are folded in half with web 10 on the outside and web 20 on the inside. This occurs at a second folding station illustrated in FIGS. 3–4.

Still referring to FIGS. 3–4, webs 10 and 20 are advanced downstream, along their respective paths, by a pair of driving rolls 15, 16 which engage the two webs 10, 20 downstream of the location where they have been folded together.

Figure 6:
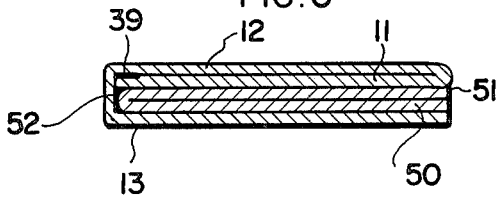
FIG. 6 is a sectional view taken along line 6—6 in FIG. 4.

Downstream of driving rolls 15, 16, the folded webs are subjected to a conventional severing operation, in which the folded webs are cut up into relatively small, individual booklets in which second part 12 of web 10 forms the front cover, marginal part 13 of web 10 forms the back cover, and marginal part 11 of web 10 forms, with second part 12 of web 10, a pocket on the inside of the booklet's front cover. The inside pages of the booklet are formed from lapped parts 50, 51 of web 20 (FIG. 6).

Webs 10 and 20 contain printed copy which must be mutually aligned or synchronized when the two webs 10, 20 are folded together in the folding step illustrated in FIGS. 3–4. To effect this synchronization, both webs 10, 20 are driven together by driving rolls 15, 16 at the same speed along their respective paths. For maximum efficiency, and to properly utilize the productive capacity of conventional high volume printing and folding equipment, webs 10, 20 are advanced along their respective paths at a relatively fast speed.

For reasons to be subsequently described, both webs 10 and 20 require tensioning at the second folding station (FIGS. 3–4). Moreover, the higher the speed at which the webs travel along their respective paths, the greater the tension in the webs; and, as previously stated, both webs 10, 20 travel at a relatively high common speed. The tension present in the webs at the second folding station is also present in upstream portions of the webs including that portion of the web at the first folding station illustrated in FIGS. 1–2.

The tension in the web is normally absorbed across the full lateral or transverse dimension of the web comprising web parts 11, 12 and 13. However, when marginal part 11 is folded out of the plane of web 10, at the first folding station, the tension previously absorbed by marginal part 11 is no longer being absorbed thereby. Instead all of the tension is being exerted on the remainder of the web comprising marginal part 13 and second part 12 which contains the transverse slit 24. Transverse slit 24 weakens the web in the area of the slit, and this could cause transverse tearing of the web from the slit, across second web part 12, during the folding step performed at the first folding station. In accordance with the present invention, procedures and structure are provided for preventing such tranverse tearing from occurring, and these procedures and apparatus will be described subsequently in greater detail.

Referring to FIG. 1, after web 10 leaves the printing station (not shown), the web moves upwardly past a roller arrangement comprising rollers 17, 18, 19 and around roller 17 and then advances to a die-cutting station defined by die-cutting roller 21 having a blade 22, located above web 10, and an anvil roller 23 located below web 10. Rollers 21, 23 rotate in the direction of the arrow shown in FIG. 1, and they form transverse slits 24 at longitudinally spaced intervals along second part 12 of web 10.

Figure 5:
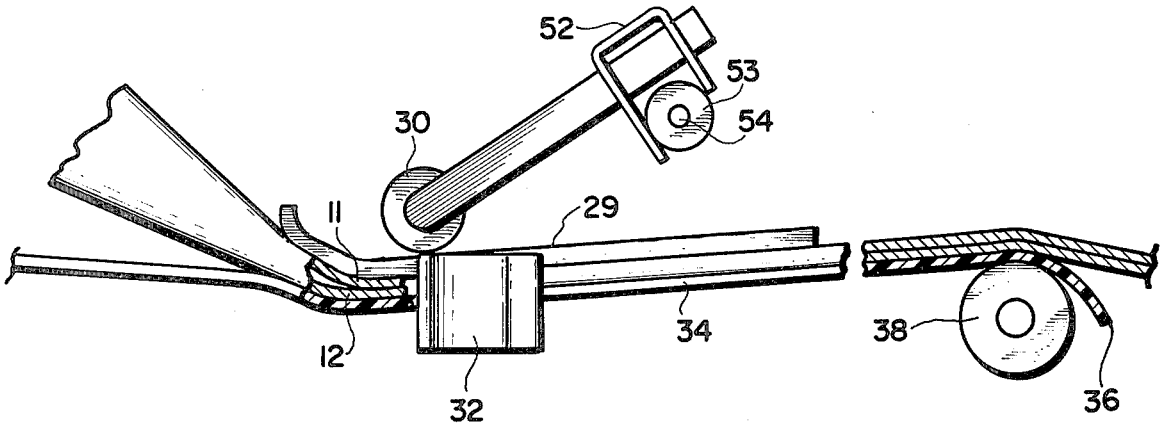
FIG. 5 is an enlarged fragmentary view, partially in section, of a folding station on the upstream portion.

Web 10 advances downstream from the die-cutting station, through a pair of rollers 26, 27 to a first folding station defined by a curved plow shoe or folding member 29 fixed to an adjustable plow shoe holder 30, both being of conventional construction. Referring to FIG. 5, plow shoe holder 30 is slidably mounted on a bracket 52 attached to a coupling 53 pivotally mounted on a shaft 54. Holder 30, with plow shoe 29, may be slidably adjusted toward and away from bracket 52 and pivotably adjusted (with bracket 52 and coupling 53) about the axis of shaft 54. Also located at the first folding station are conventional guide elements 31, 32. Other guide elements of conventional construction may be located at such appropriate positions around the first folding station as may suggest themselves to those skilled in the art.

At the first folding station, marginal part 11 of web 10 is folded out of the plane of the web and then into lapping relation with second part 12 of that web (see FIG. 5). As previously indicated, because of considerations which arise downstream of the first folding station, web 10 is under tension at that folding station (as well as at other locations upstream and downstream thereof.).

Curved plow shoe 29 presses down on web 10 at the first folding station and contributes to the tension in the web. In addition, when marginal part 11 is folded out of the plane of web 10, it no longer absorbs some of the tension exerted on web 10 at the first folding station, so that more tension is therefore exerted on second part 12 of web 10. Because second web part 12 contains transverse slit 24 and because second web part 12 is absorbing an increased amount of tension during the time marginal part 11 is folded out of the plane of web 10, there is an increased likelihood at that stage of the operation of a transverse tear from slit 24 across second web part 12. In accordance with the present invention, procedures and apparatus are provided to prevent such tearing from occurring.

More particularly, referring to FIGS. 1, 2 and 5, there is provided a longitudinally extending ribbon 34 of flexible material having upstream and downstream ends 35, 36 respectively. Upstream ribbon end 35 is anchored in a clamp 37 located below web 10. Ribbon 34 is located below the path followed by web 10, in close proximity to the web in the vicinity of the first folding station. Ribbon 34 extends over a roller 38, and the ribbon's downstream end 36 hangs free. All that part of ribbon 34 which is located downstream of anchoring clamp 37 is unanchored.

Second part 12 of web 10 runs over ribbon 34 during the folding step at the first folding station. In the illustrated embodiment, ribbon 34 has approximately the same dimension in a transverse direction as does second web part 12 (FIG. 2). Because of the manner in which ribbon 34 is anchored and arranged in relation to web 10, the ribbon conforms to the contour of second web part 12 during at least that part of the folding step in which marginal web part 11 is folded out of the plane of the web. As a result, there is absorbed into conformed ribbon 34 some of the tension exerted on second web part 12 during the folding step.

There is a drag exerted by conformed ribbon 34 against second web part 12. This drag or partial adherence between ribbon 34 and second web part 12 is proportional to the coeffecient of friction of the material of which ribbon 34 is composed or to the static electricity developed by the rubbing of web 10 over ribbon 34, or a combination of the two. The greater the adherence or drag exerted by ribbon 34 against second web part 12, the more tension is absorbed by ribbon 34 from second web part 12.

However, if the drag exerted by ribbon 34 is too great, it could cause a break in web 10. Therefore, ribbon 34 must be composed of a material which, under the conditions in existence at the first folding station, will absorb from second web part 12 enough tension to prevent the transverse tearing of second web part 12, but the drag must be less than that which would cause web 10 to break.

One such material of which ribbon 34 may be composed is the plastic material used as the removable backing strip on rolled, double-sided adhesive tape (i.e., tape having adhesive on both sides thereof), marketed by Minnesota Mining and Manufacturing Company of Saint Paul, Minn. The adequacy or inadequacy of other materials may be determined by trial and error. For example, Mylar polyester plastic film has proven to be inadequate as a material for ribbon 34. The principal considerations involved in selecting an adequate material are that either its coefficient of friction or its static electricity characteristics, or both, be sufficient to absorb a substantial amount of tension from second web part 12 so as to prevent transverse tearing thereof, yet do so without creating such a drag as to break the web.

As previously noted, downstream end 36 of ribbon 34 hangs free, rather than being anchored as is upstream ribbon end 35. If downstream ribbon end 36 were anchored, it would less effective, e.g., there would be a decrease in the conformity of ribbon 34 to web part 12. With downstream ribbon end 36 unanchored, ribbon 34 is better able to conform to the contour of second web part 12, in the vicinity in which marginal web part 11 has been folded out of the plane of the web.

After marginal part 11 is folded into lapping relation with second web part 12, the web is advanced in a downstream direction with web parts 11, 12 in lapping relation.

Lapped web parts 11, 12 may be used to form an inside pocket on a booklet cover, and in such a case, adhesive is applied in a longitudinal strip 39 on the top surface of second web part 12, adjacent the location thereon where it will be overlapped by the longitudinal edge 25 of marginal part 11 (FIGS. 2 and 4). In addition, longitudinally spaced lateral lines of adhesive are applied across web second part 12, as at 40 (FIG. 2). Adhesive strip 39 and adhesive lines 40 are applied to web second part 12 at a location downstream of die-cutting rollers 26, 27 and upstream of the first folding station. The adhesive is applied by conventional adhesive-applying equipment, not shown in the figures.

Referring now to FIGS. 3–4, web 10 advances in a downstream direction from the first folding station over a roller 41 to a second folding station defined by a plow shoe 42 fixed to an adjustable plow shoe holder 43, both of conventional construction. The second folding station also includes a pair of guide elements 44, 45, also of conventional construction. The folding apparatus employed at the second folding station is similar to that employed at the first folding station and includes adjusting structure (not shown) similar to that employed at the first folding station at 52–54 (FIG. 5).

While web 10 was undergoing die-cutting and folding along the path portion illustrated in FIGS. 1–2, web 20 was passing across the top of rollers 46, 47 (FIG. 1) advancing in a downstream direction toward the path portion illustrated in FIGS. 3–4.

Upstream of the second folding station, web 20 passes under a roller 48 located just above the path followed by web 10. As seen in FIG. 4, web 20 has a transverse or lateral dimension corresponding approximately to that of web 10 after it has undergone folding at the first folding station (FIGS. 1–2). Roller 48 comprises structure for laying web 20 atop web 10, in lapping relation therewith, at a location between the first and second folding stations. The two webs are then advanced downstream together, from roller 48, along a common path, in lapping relation. Driving rolls 15, 16 advance both webs 10, 20 downstream along their respective paths by pulling on the webs from a location downstream of the second folding station. Both webs 10, 20 are tensioned in the planes of the webs, at the second folding station.

At the second folding station, web 10 is folded around the outside of web 20, and web 20 is folded along a longitudinally extending fold line 49. Also at the second folding station, lapped parts 11 and 12 of web 10 are folded out of the plane of web 10 and then into lapping relation with marginal part 13 of web 10.

As an alternative to the folding procedure illustrated in FIGS. 3–4, marginal part 13 of web 10 may be folded out of the plane of web 10 and then into lapping relation with previously lapped parts 11 and 12 of web 10. In addition, web 20 may be folded separately, upstream of the second folding station, and then, in its folded condition, laid atop the marginal part of web 10 which remains in the plane of web 10 during the second folding step.

In order to effect the desired fold at the second folding station (FIGS. 3–4), a predetermined minimum tension is required on webs 10, 20. As previously indicated, much of this tension is provided by driving rolls 15, 16, and this contributes to the tension in web 10 upstream of the second folding station.

The two longitudinally extending parts of web 20, folded into lapping relation at the second folding station, are indicated at 50, 51 in FIGS. 4 and 6. The relationship of the various parts of webs 10, 20 after the second folding step is shown in FIG. 6.

As part of a booklet manufacturing operation, web 20 is adhered to web 10 by a strip of adhesive 52 applied to the upper surface of web 10 at about the location where longitudinal fold line 49 on web 20 will lie in superimposed relation to web 10 (FIG. 4). Adhesive strip 52 is applied to web 10 with conventional equipment (not shown) at a location downstream of the first folding station and upstream of roller 48 which effects the adherence of webs 10 and 20.

After the webs have been so adhered and have been folded into the relationship illustrated in FIG. 6, they are cut into booklets by severing the web at longitudinally spaced locations thereon. When the webs have been thus severed, parts 50, 51 of web 20 constitute booklet pages adhered to the backbone of the booklet at 52. The webs are severed into booklets, along transverse lines, extending laterally across the folded, lapped web parts, at a severing station (not shown) downstream of driving rolls 15, 16.

If desired, the booklet resulting from severing folded webs 10, 20 can be provided with additional pages, other than the pages provided by web parts 50, 51 (FIG. 6). This can be accomplished by providing an additional web having a transverse dimension similar to that of web 20, laying that additional web atop web 20, upstream of the location where web 20 is laid atop web 10, adhering the additional web to web 20, along a longitudinally extending strip of adhesive, similar to the strip of adhesive 52 which adheres web 20 to web 10, and then folding the additional web with web 20 at or upstream of the second folding station and then folding web 10 around web 20.

The transverse tearing problem, which the method and apparatus in accordance with the present invention is intended to eliminate, could also be eliminated by running web 10 at a much slower speed, thereby relieving some of the tension in the web. However, all of the other webs (e.g., web 20) with which web 10 is folded into lapping relation at the second folding station, can be run at a much higher speed, and there is no tearing problem with these other webs because they do not have transverse slits as does web 10. It would be undesirable to slow down web 20, or any additional like webs, merely because of problems which arise when web 10 is run at a high speed, when such problems are not present in web 20 and like webs. A method and apparatus in accordance with the present invention permits web 20 and like webs to be run at the relatively high speed at which they would ordinarily be run, and permits web 10 to be run at the same relatively high speed, without the transverse tearing problem.

The foregoing detailed description has been given for clearness of understanding only, and no unnecessary limitations should be understood therefrom, as modifications will be obvious to those skilled in the art.

I claim:

1. A method for folding a continuous web of paper having a transverse slit, said method comprising the steps of:

providing a continuous web of paper having a longitudinally extending marginal part and a longitudinally extending second part located alongside said marginal part;

advancing said continuous web downstream in a longitudinal direction along a predetermined path;

providing a folding station at a predetermined location on said path;

cutting a transverse slit in said second part of the web at a location upstream of said folding station;

tensioning said web, in the plane of the web, at said folding station;

providing a longitudinally extending ribbon of flexible material having upstream and downstream ends;

locating said ribbon of flexible material below said path in close proximity to said web in the vicinity of said folding station;

folding said marginal part of the web out of the plane of the web and then into lapping relation with the second part of the web, at the folding station;

running said second part of the web over said ribbon of flexible material during said folding step;

conforming said ribbon to the contour of said second web part during at least that part of the folding step in which said marginal part of the web has been folded out of the plane of the web;

absorbing into said conformed ribbon some of the tension exerted on the second part of said web during said folding step;

and exerting a drag by said conformed ribbon against said second part below that which would break said tensioned web;

whereby there is prevented transverse tearing from said slit, across the second part of the web, during said folding step.

2. A method as recited in claim 1 and comprising:

anchoring a part of said ribbon of flexible material at an anchoring location which is upstream of said folding station;

and maintaining in an unanchored condition that part of said ribbon which is located downstream of said anchoring location.

3. A method as recited in claim 2 wherein:

said downstream end of the ribbon hangs free.

4. A method as recited in claim 2 wherein:

said anchoring step comprises anchoring said ribbon at its upstream end.

5. A method as recited in claim 1 and comprising:

advancing said web downstream from said folding station with said marginal part and said second part in lapping relation;

providing said web with an additional longitudinally extending marginal part located alongside said second part of the web, opposite said first-recited marginal part;

providing a second folding station downstream of said first-recited folding station;

and folding one of said marginal parts out of the plane of the web and then into lapping relation with the other of said marginal parts, at said second folding station.

6. A method as recited in claim 5 wherein:

said first-recited advancing step comprising pulling on said web from a location downstream of said second folding station.

7. A method as recited in claim 5 and comprising:

providing a second continuous web of paper having a transverse dimension no greater than that of said first-recited web after said first-recited folding step;

laying said second web atop said first-recited web, in lapping relation therewith, at a location between said folding stations;

advancing the two webs downstream together, along said path, in said lapping relation, from said laying location;

said second-recited folding step comprising folding said first-recited web around the outside of said second web;

and tensioning both of said webs in the planes of the webs, at said second folding station.

8. An apparatus for folding a continuous web of paper having a longitudinally extending marginal part and a longitudinally extending second part located alongside said marginal part, said apparatus comprising:

means for advancing said continuous web downstream in a longitudinal direction along a predetermined path;

means defining a folding station at a predetermined location on said path;

means for cutting a transverse slit in said second part of the web at a location upstream of said folding station;

means for tensioning said web, in the plane of the web, at least, at said folding station;

a longitudinally extending ribbon of flexible material having upstream and downstream ends;

means for locating said ribbon of flexible material below said path in close proximity to said web in the vicinity of said folding station;

means for folding said marginal part of the web out of the plane of the web and then into lapping relation with the second part of the web, at the folding station;

means for running said second part of the web over said ribbon of flexible material at said folding station;

and means for conforming said ribbon to the contour of said second web part in the vicinity in which said marginal part of the web has been folded out of the plane of the web;

said conformed ribbon comprising means for absorbing thereinto some of the tension exerted on the second part of said web at said folding station;

said conformed ribbon comprising means for exerting a drag against said second part below that drag which would break said tensioned web;

whereby there is prevented transverse tearing from said slit, across the second part of the web, at said folding station.

9. An apparatus as recited in claim 8 and comprising:

means for anchoring a part of said ribbon of flexible material at an anchoring location which is upstream of said folding station;

and means for maintaining in an unanchored condition that part of said ribbon which is located downstream of said anchoring location.

10. An apparatus as recited in claim 9 wherein:

said downstream end of the ribbon hangs free.

11. An apparatus as recited in claim 9 wherein:

said anchoring means comprises means for anchoring said ribbon at its upstream end.

12. An apparatus as recited in claim 8 for folding a web having an additional longitudinally extending marginal part located alongside said second part of the web, opposite said first-recited marginal part, said apparatus further comprising:

means for advancing said web downstream from said folding station with said marginal part and said second part in lapping relation;

means defining a second folding station downstream of said first-recited folding station;

and means for folding one of said marginal parts out of the plane of the web and then into lapping relation with the other of said marginal parts, at said second folding station.

13. An apparatus as recited in claim 12 wherein:

said first-recited advancing means comprises means for pulling on said web from a location downstream of said second folding station.

14. An apparatus as recited in claim 12 and comprising:

means for receiving a second continuous web of paper having a transverse dimension no greater than that of said first-recited web after said first-recited folding step;

means for laying said second web atop said first-recited web, in lapping relation therewith, at a location between said folding stations;

said advancing means comprising means for advancing the two webs downstream together, along said path, in said lapping relation, from said laying location;

said second-recited folding means comprising means for folding said first-recited web around the outside of said second web;

and said tensioning means comprises means for tensioning both of said webs in the planes of the webs, at said second folding station.

* * * * *